US006811521B1

(12) United States Patent
Musso

(10) Patent No.: US 6,811,521 B1
(45) Date of Patent: Nov. 2, 2004

(54) SPORTING APPARATUS TO CARRY OUT EXERCISES ACCORDING TO THE NATURAL PHYSIOLOGICAL TRAJECTORY OF EACH PERSON

(75) Inventor: Giuseppe Musso, Partinico (IT)

(73) Assignee: Laser Fit di Musso Giuseppe, Partinico (IT)

( * ) Notice: Subject to any disclaimer, the term of this patent is extended or adjusted under 35 U.S.C. 154(b) by 420 days.

(21) Appl. No.: 10/089,767

(22) PCT Filed: Oct. 2, 2000

(86) PCT No.: PCT/IT00/00392

§ 371 (c)(1),
(2), (4) Date: Apr. 2, 2002

(87) PCT Pub. No.: WO01/24886

PCT Pub. Date: Apr. 12, 2001

(30) Foreign Application Priority Data

Oct. 5, 1999 (IT) ..... PA99A0011

(51) Int. Cl.[7] ..... A63B 21/072; A63B 21/08

(52) U.S. Cl. ..... 482/104; 482/98; 482/135; 482/137; 482/94

(58) Field of Search ..... 482/93, 94, 97, 482/98, 100, 101, 104, 106, 135–138

(56) References Cited

U.S. PATENT DOCUMENTS

| | | | | |
|---|---|---|---|---|
| 3,235,255 A | | 2/1966 | Leflar | |
| 3,612,523 A | * | 10/1971 | Glynn | 482/98 |
| 4,635,934 A | * | 1/1987 | Roethke | 482/104 |
| 4,795,149 A | | 1/1989 | Pearson | |
| 4,836,535 A | * | 6/1989 | Pearson | 482/101 |
| 5,044,629 A | * | 9/1991 | Ryan et al. | 482/101 |
| 5,050,868 A | * | 9/1991 | Pearson | 482/94 |
| 5,116,297 A | * | 5/1992 | Stonecipher | 482/97 |
| 5,215,510 A | * | 6/1993 | Baran | 482/104 |
| 5,529,558 A | | 6/1996 | Koenig | |
| 5,669,859 A | * | 9/1997 | Liggett et al. | 482/94 |

FOREIGN PATENT DOCUMENTS

| | | | | |
|---|---|---|---|---|
| EP | 194220 A1 | * | 9/1986 | A63B/21/00 |
| EP | 258802 A1 | * | 3/1988 | A63B/21/06 |
| FR | 2561528 A1 | * | 9/1985 | A63B/23/00 |

* cited by examiner

*Primary Examiner*—Nicholas D. Lucchesi
*Assistant Examiner*—Victor Hwang
(74) *Attorney, Agent, or Firm*—Dann, Dorfman, Herrell and Skillman, P.C.; Henry H. Skillman

(57) ABSTRACT

The invention relates to a sporting apparatus (1) to carry out exercises according to the natural physiological trajectory of each person, comprising a support structure (2), or frame, provided with lateral elements (11), with base or resting elements (4) for said lateral elements (11), and with at least a transverse element (19) for fixing said lateral elements (11), the sporting apparatus (1) further providing two sliding elements (3), or poles, substantially vertically provided in correspondence of said lateral elements (11) of the frame (2), said sliding elements (3) being hinged above the same lateral elements (11), and being freely oscillating along said base (4) or resting elements of said lateral elements (11), and provided with guide means (6, 7) to guide the sliding of a weight (9) bearing bar (8); and a counterweight transverse element (10), provided above said sliding elements (3), in such a way to join the same, thus creating a single oscillating structure.

8 Claims, 10 Drawing Sheets

SPORTING APPARATUS TO CARRY OUT EXERCISES ACCORDING TO THE NATURAL PHYSIOLOGICAL TRAJECTORY OF EACH PERSON

The present invention concerns a sporting apparatus to carry out exercises according to the natural physiological trajectory of each person.

More specifically, the invention concerns a sporting apparatus of the above kind, suitably studied to obtain that the bar is guided to follow the trajectory that is physiologically conferred by the user during the execution of the exercise.

The use of bars in gymnasium to carry out different physical exercises, particularly to power the upper portion of the body, is well known to everybody.

The main object of the present invention is that of providing an improved apparatus to allow to adapt the bar, during the trajectory followed while carrying out the exercise, to the physiological trajectory that is conferred to the same apparatus by each different user.

By the solution suggested according to the present invention, besides being possible to carry out the exercise with the bar in an extremely proper technical position, it is also possible to carry out different exercises beyond those possible with the standard apparatuses.

These and other results are obtained, according to the present invention, suggesting a technical solution for a sporting apparatus, providing two lateral elements (poles) having a pendulum motion, hinged above on the apparatus supporting structure, and with the base portion free, said base portion being eventually blocked in different positions according to the specific exercise to be carried out.

It is therefore specific object of the present invention a sporting apparatus to carry out exercises according to the natural physiological trajectory of each person, comprising a support structure, or frame, provided with lateral elements, with base or resting elements for said lateral elements, and with at least a transverse element for fixing said lateral elements, the sporting apparatus further providing two sliding elements, or poles, substantially vertically provided in correspondence of said lateral elements of the frame, said sliding elements being hinged above the same lateral elements, and being freely oscillating along said base or resting elements of said lateral elements, and provided with guide means to guide the sliding of a weight bearing bar; and a counterweight transverse element, provided above said sliding elements, in such a way to join the same, thus creating a single oscillating structure.

Preferably, according to the invention, said sliding elements, or poles, can be provided with means for their lower blocking on the basis of said frame, particularly a retractable pin interacting with suitable holes realized on said base of the frame.

Still according to the invention, wheels can be provided under said sliding elements or poles.

Furthermore, according to the invention, said means guiding the sliding of the bar can be comprised of cylindrical guides provided with axial bearing.

Always according to the invention, it can be provided a safety lever device locking the bar, preventing the same from accidentally falling.

Still according to the invention, pin for positioning the weights can be provided on said frame.

Furthermore, according to the invention, said sliding elements are hinged on pins provided above the lateral elements of said frame.

The present invention will be now described, for illustrative but not limitative purposes, according to its preferred embodiments, with particular reference to the figures of the enclosed drawings, wherein.

Figure 10A:
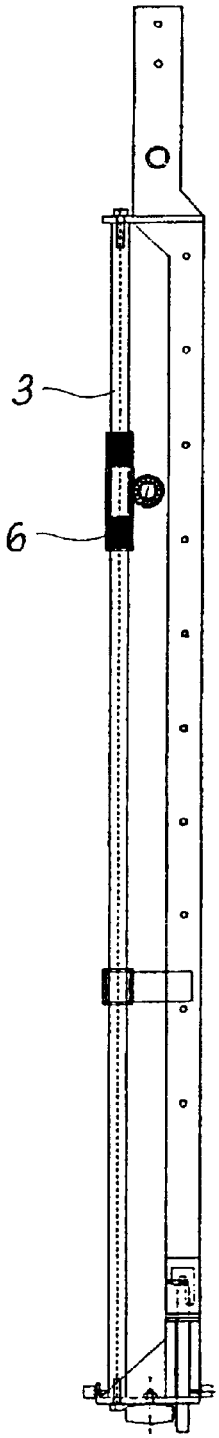
Figure 10B:
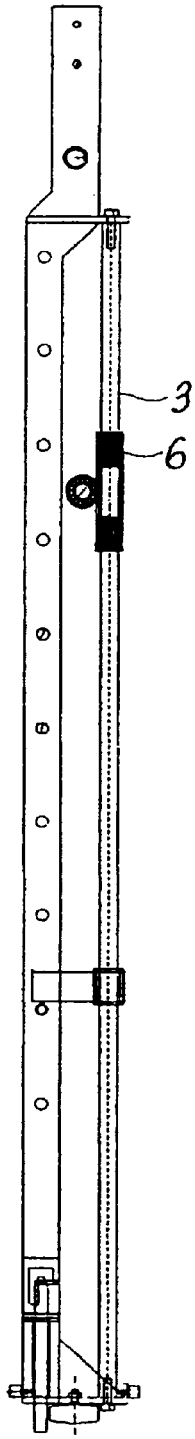
Figure 10C:
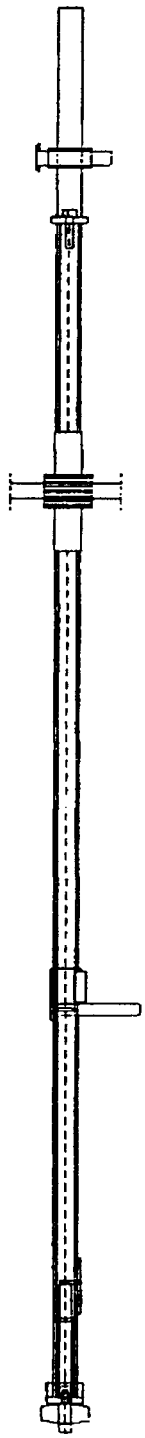
Figure 11:
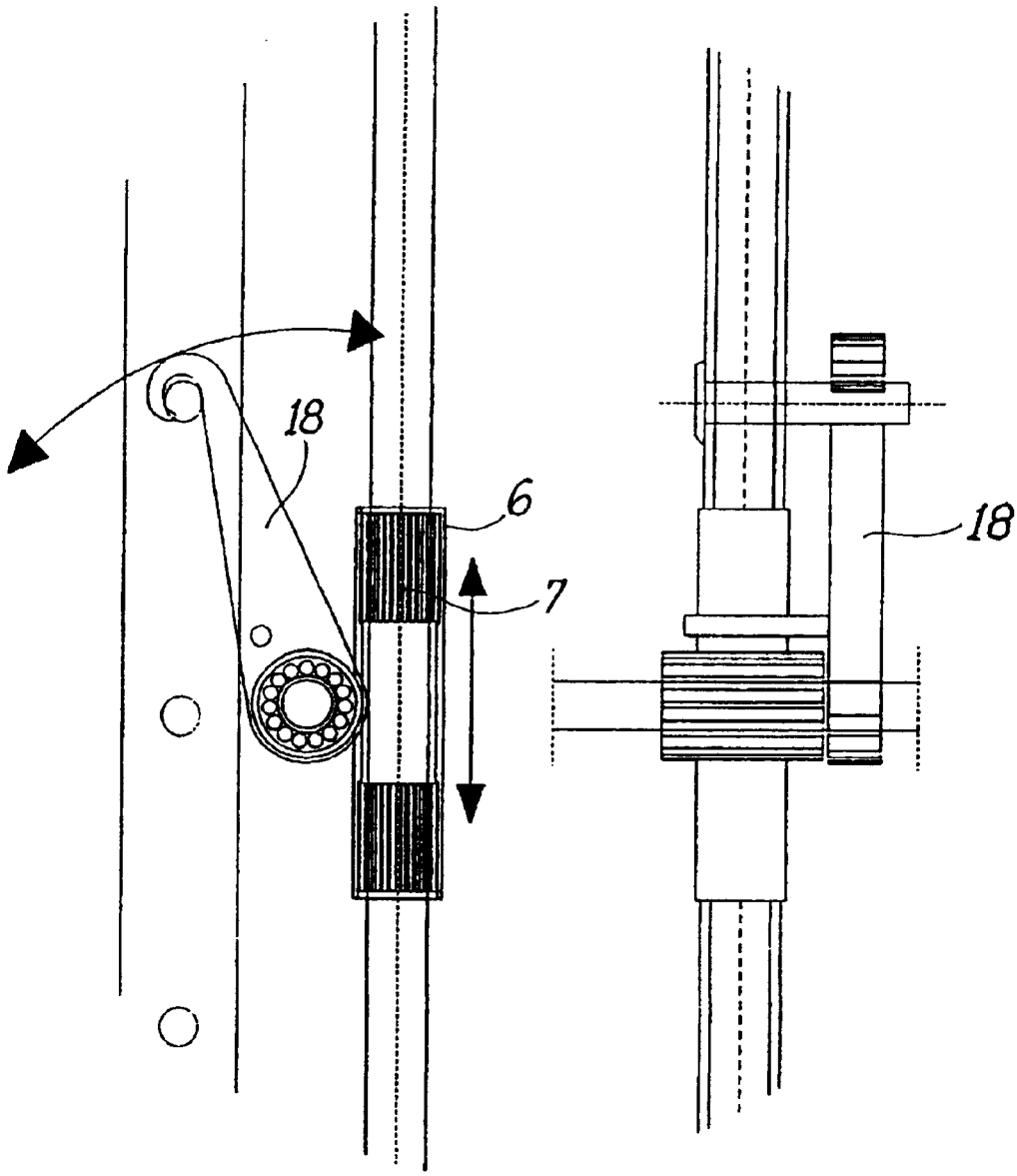

FIGS. 10*a*, 10*b* and 10*c* are lateral views of the sliding bars of the apparatus according to the invention; and FIG. 11 shows the particular of the bar sliding system.

Observing now the figures of the enclose drawings, it is shown an apparatus 1 according to the invention, providing a support frame 2.

Two sliding elements 3, or poles, are hinged above said structure 2, to obtain a pendulum motion, while they are to move at the bottom along the base 4.

Holes 5 are provided on said base 4 to lock the position of the poles 3 in function of the exercise that will be carried out by the apparatus 1.

Along said poles 3, slidable cylindrical guides 6 are provided, preferably comprised of hardened steel, with the interposition of axial bearings 7 (see FIG. 11) to obtain the sliding of the bar 8, with the relevant weights 9, along the same poles 3.

Said motion of the bar 8 along the poles 3 is balanced by an upper counterweight 10, coupled with both the poles 3, thus guaranteeing the parallel rotation motion.

Mainly, the various parts of the apparatus according to the invention are realized employing section bars and metallic plates, assembled by suitable bolts and weldings.

Figure 1:
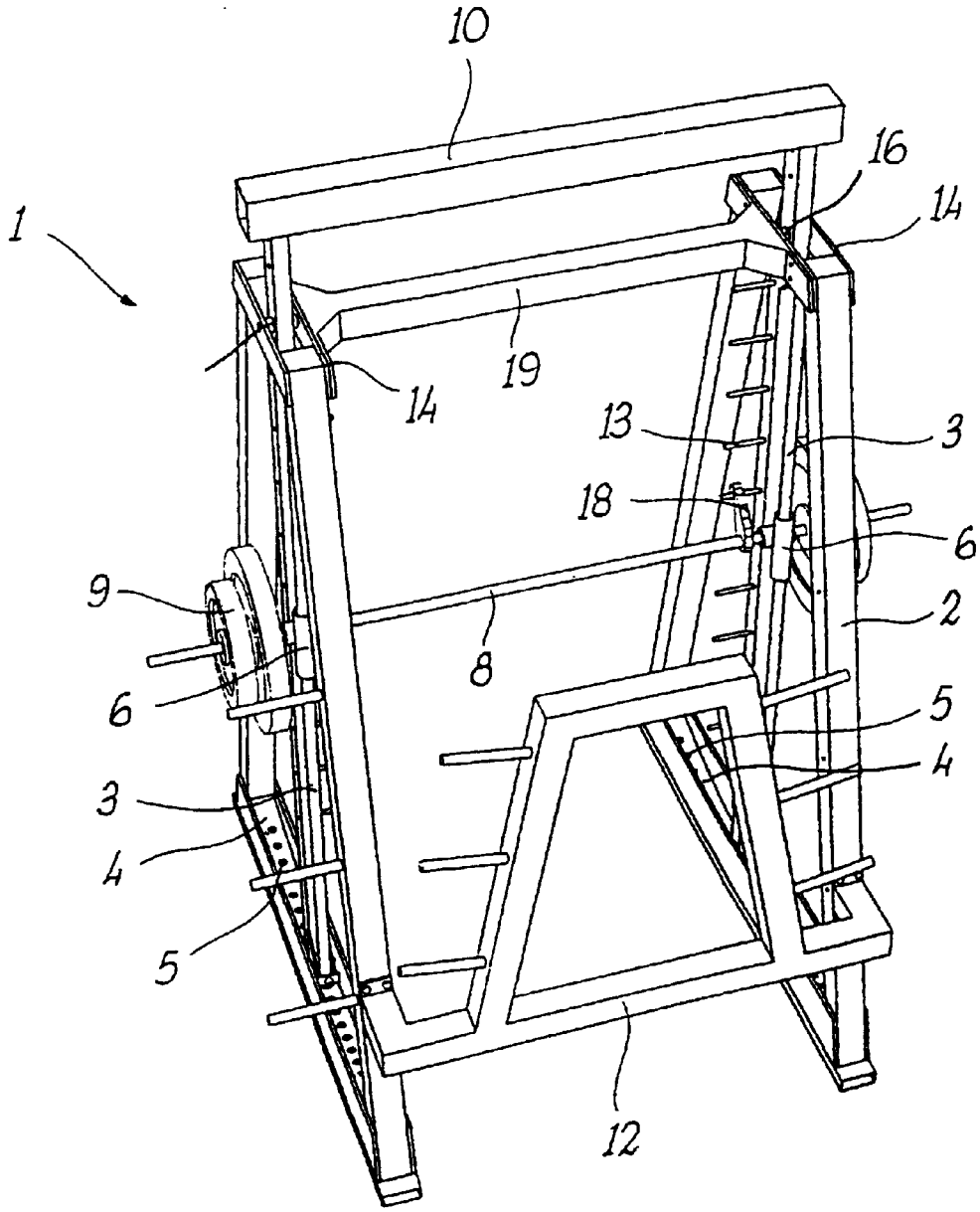
FIG. 1 is a perspective rear view of an embodiment of a sporting apparatus according to the invention.
Figure 2:
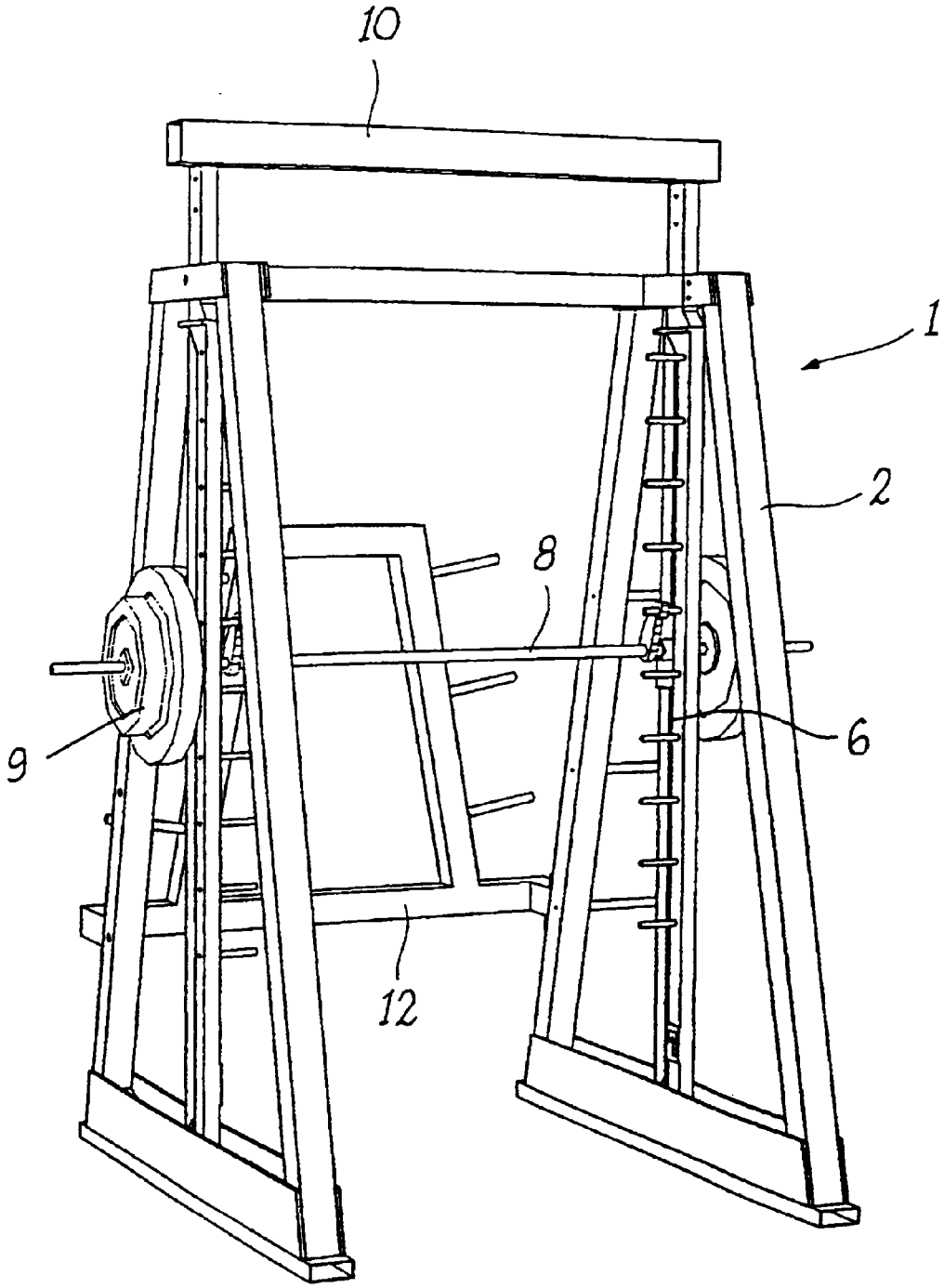
FIG. 2 is a perspective front view of the sporting apparatus of FIG. 1.
Figure 3:
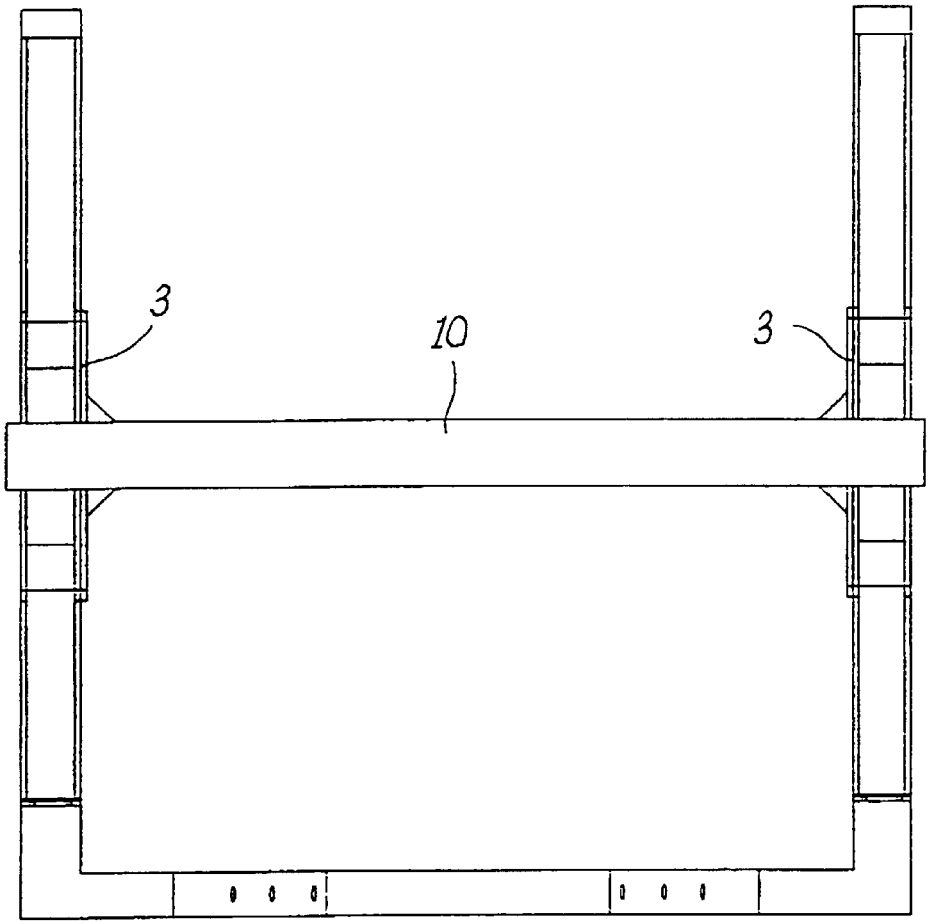
FIG. 3 is top view of the apparatus of FIG. 1.
Figure 4:
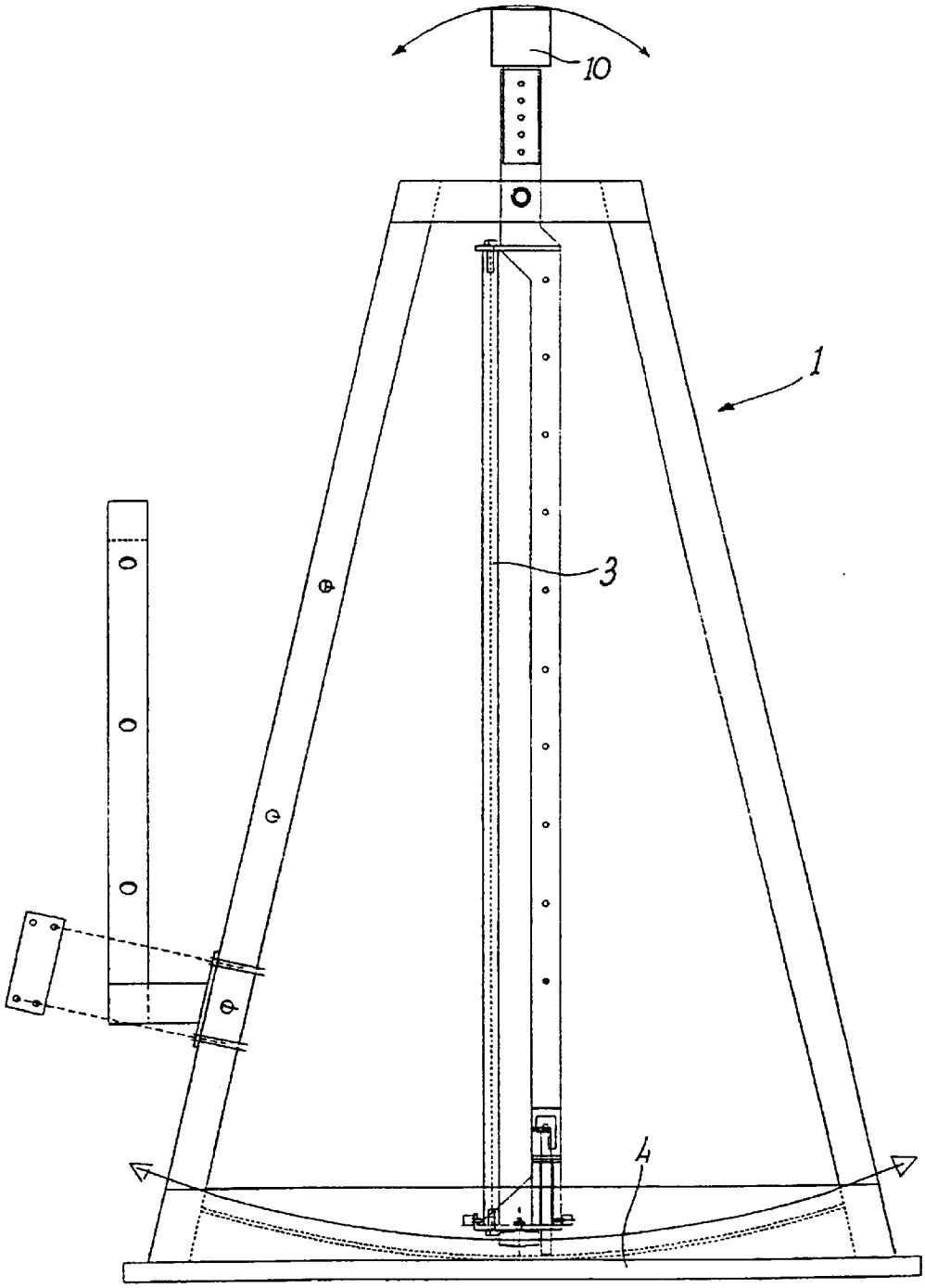
FIG. 4 is a lateral view of the apparatus of FIG. 1.
Figure 5:
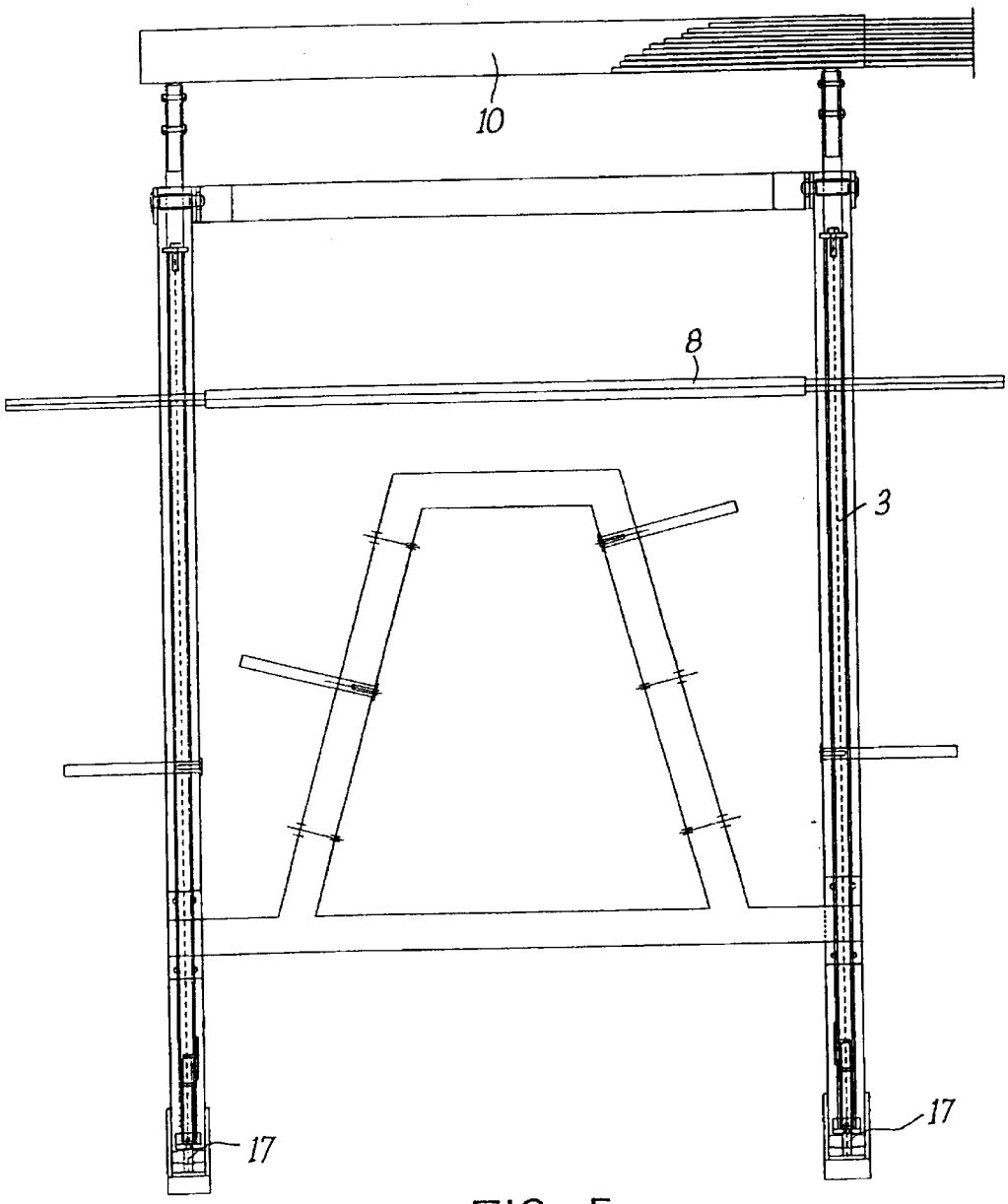
FIG. 5 is a rear view of the apparatus of FIG. 1.
Figure 6:
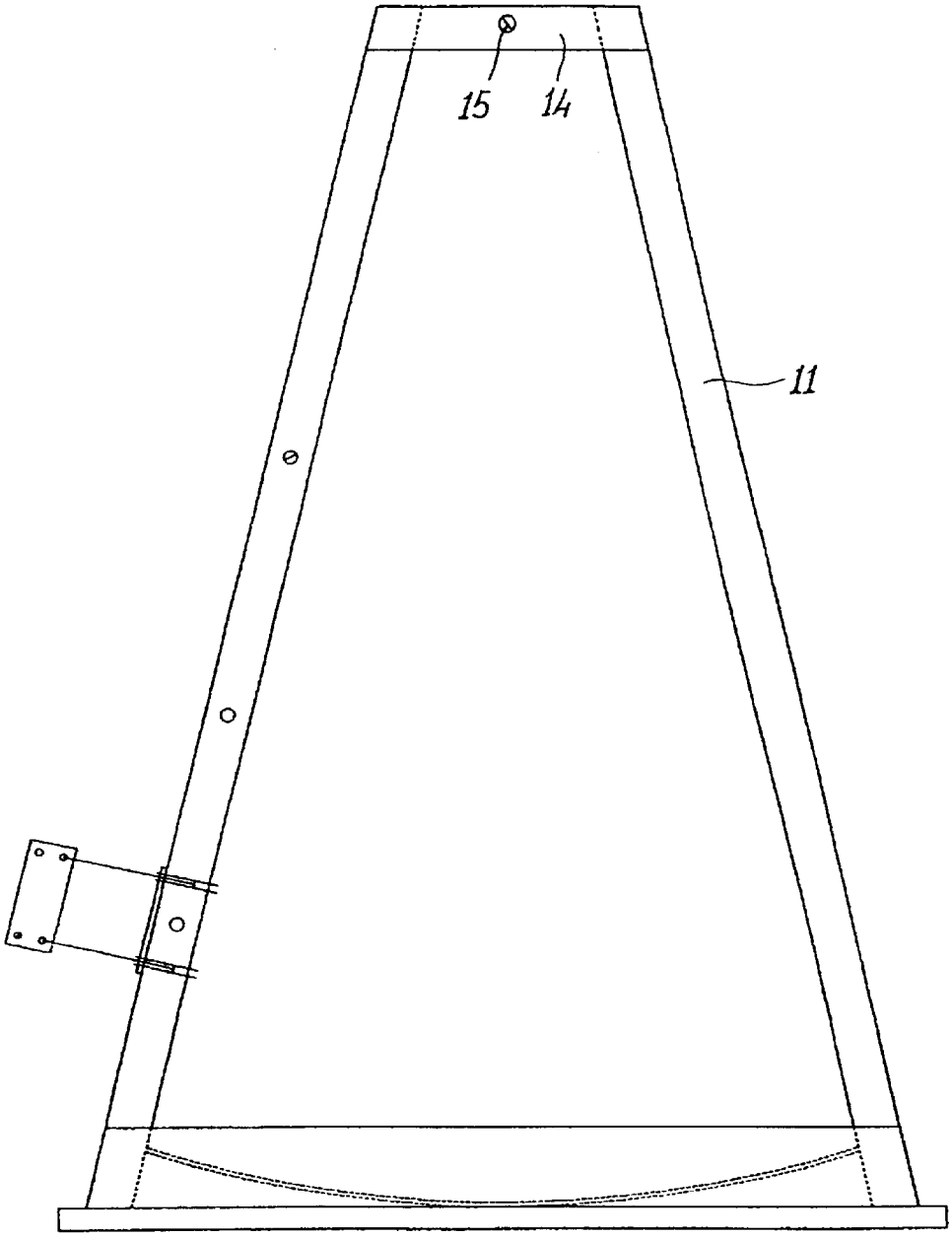
FIG. 6 is an outer lateral view of a particular of the apparatus of FIG. 1.
Figure 8:
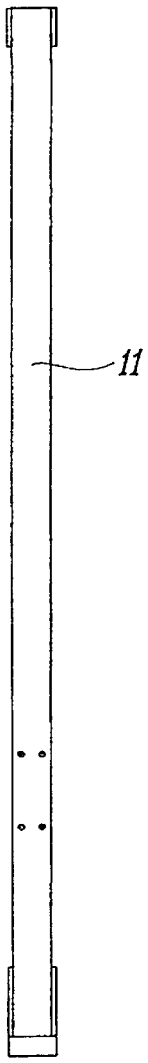
FIG. 8 is a lateral view of the particular of FIG. 7.
Figure 7:
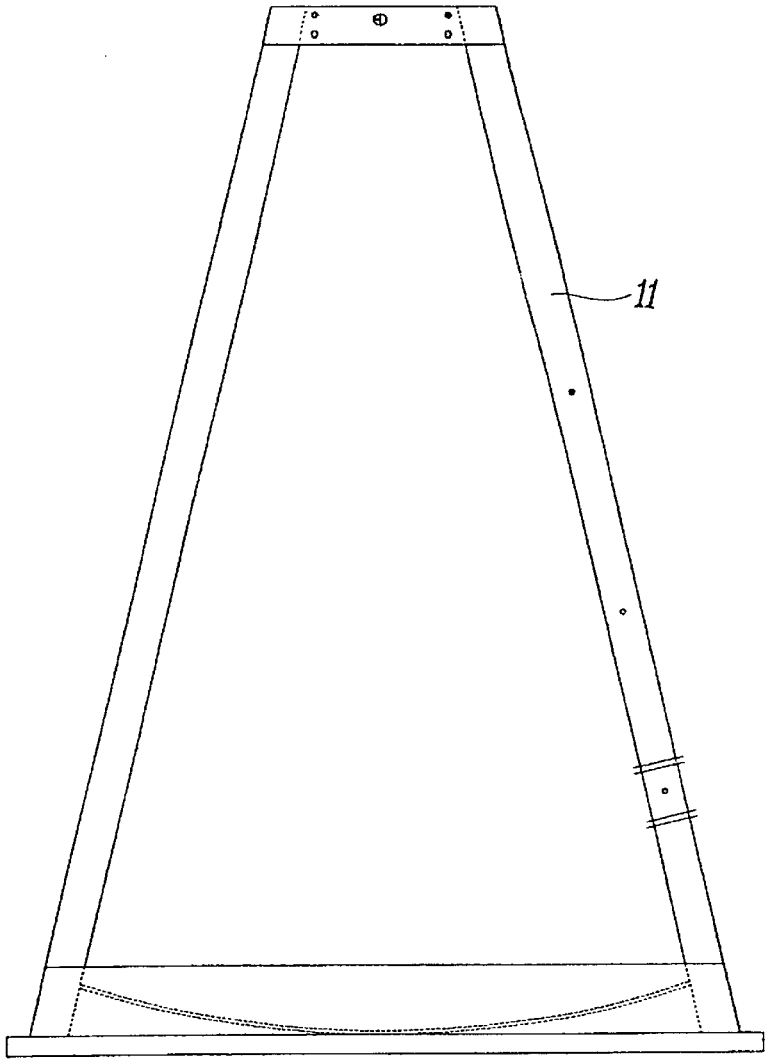
FIG. 7 is an outer lateral view of a particular of the apparatus of FIG. 1.
Figure 9:
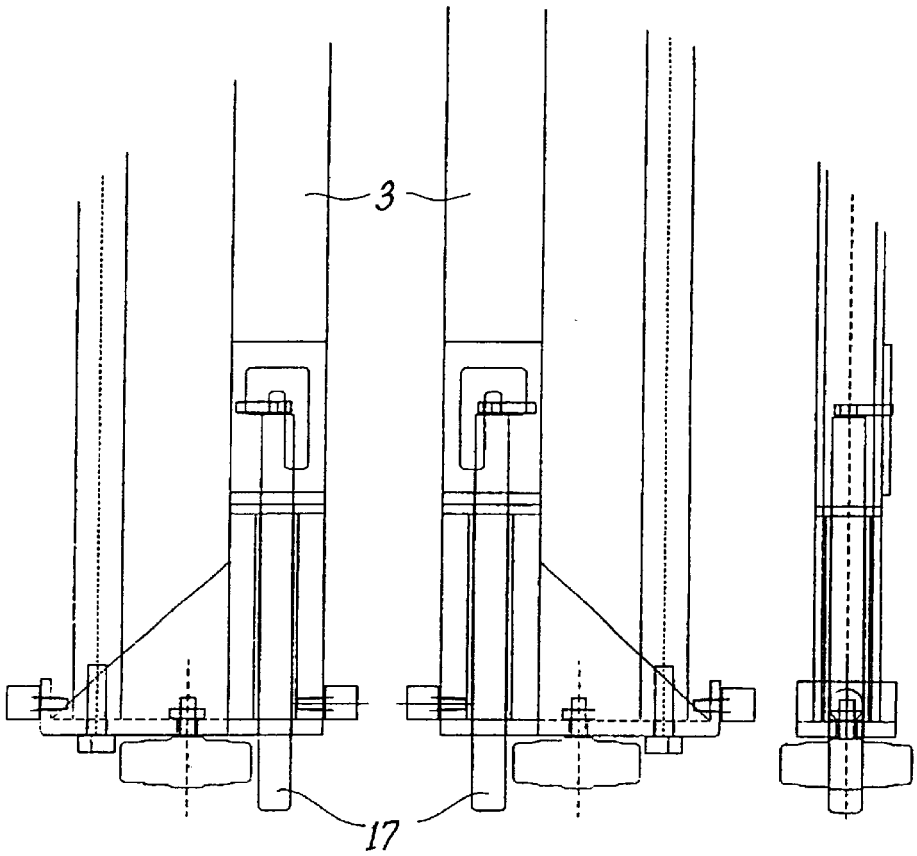
FIG. 9 shows the blocking system of the bar of the apparatus of FIG. 1.

Observing particularly FIGS. 6, 7 and 8, structure 2 of the apparatus 1 according to the invention provides two lateral shoulders 11, that in the embodiment shown, are comprised of two section bars of 80×80, having fixing holes of the connecting lower structure 12, and the fixing of the weight bearing pins 13.

On the above, two welded plates 14 are provided, said plates being provided with holes 15 through which pins 16 passes for the pendulum motion of the poles 3 and of the upper counterweight 10.

Said poles 3 are provided in an eccentric position with respect to the vertical line passing through said holes 15, in such a way to allow the coupling of the guide 6, with the relevant axial bearing 7, which allows the vertical motion of the bar.

At the bottom, said poles 3 are provided with steel pins 17, that can be coupled with said holes 5, for fixing the position in function of the particular exercise.

It is further provided a lever safety device 18 to prevent the falling of the bar, which is adjustable in function of the exercise to be carried out.

Below said poles 3, wheels are provided, and having the rotation axis vertically placed.

The upper connection between the shoulders 11, thus stiffening the structure, is obtained by the bar 19.

By the solution according to the invention, a sporting apparatus 1 is obtained allowing to carry out the exercises taking a proper position, thus avoiding all the drawbacks deriving from a wrong position.

Particularly, the apparatus according to the invention allows to substantially upset the exercise, that is known as "squat" just in view of the fact that it is not possible to release at the bottom the poles 3, that are provided with a pendulum motion. In this way, it is possible to freely and properly carry out the exercise, with the bar 8 that automatically follows the physiological trajectory.

In the same way, apparatus 1 according to the invention, coupled with a bench, provided with adjustable seat and back, such as those already provided, allows to carry out that are usually carried out with other apparatuses, but with the user obliged to take wrong positions. We particularly refer to the exercises relevant to the breast muscles (lower pectoral muscles), presently carried out making the user take a position providing the level of the head lower than the body, with the consequent excessive blood pressure within the head.

On the contrary, by the apparatus 1 according to the invention, it is possible to take a proper position, thus avoiding the above mentioned drawbacks.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. Sporting apparatus to carry out exercises according to the natural physiological trajectory of each person, characterized in that it comprises a support structure, or frame, provided with lateral elements, with base or resting elements for said lateral elements, and with at least a transverse element for fixing said lateral elements, the sporting apparatus further providing two sliding elements, or poles, substantially vertically provided in correspondence of said lateral elements of the frame, said sliding elements being hinged above the same lateral elements, and being freely oscillating along said base or resting elements of said lateral elements, and provided with guide means to guide the sliding of a weight bearing bar; and a counterweight transverse element, provided above said sliding elements, in such a way to join the same, thus creating a single oscillating structure.

2. Sporting apparatus according to claim 1, characterized in that said sliding elements, or poles, are provided with means for their lower blocking on the basis of said frame.

3. Sporting apparatus according to claim 2, characterized in that said means for the lower blocking on the basis of said frame of the sliding elements, or poles are comprised of a retractable pin interacting with suitable holes realized on said base of the frame.

4. Sporting apparatus according to one of the preceding claims, characterized in that wheels are provided under said sliding elements or poles.

5. Sporting apparatus according to one of the preceding claims, characterized in that said means guiding the sliding of the bar are comprised of cylindrical guides provided with axial bearing.

6. Sporting apparatus according to one of the preceding claims, characterized in that a safety lever device locking the bar is provided, preventing the same from accidentally falling.

7. Sporting apparatus according to one of the preceding claims, characterized in that pin for positioning the weights are provided on said frame.

8. Sporting apparatus according to one of the preceding claims, characterized in that said sliding elements are hinged on pins provided above the lateral elements of said frame.

* * * * *

UNITED STATES PATENT AND TRADEMARK OFFICE

CERTIFICATE OF CORRECTION

PATENT NO. : 6,811,521 B1
DATED : November 2, 2004
INVENTOR(S) : Musso

It is certified that error appears in the above-identified patent and that said Letters Patent is hereby corrected as shown below:

Title page,
Item [30], Foreign Application Priority Data, should read:

-- [30] Foreign Application Priority Data
Oct. 5, 1999 (IT) …….PA99A000011 --.

Signed and Sealed this

Eleventh Day of January, 2005

JON W. DUDAS
*Director of the United States Patent and Trademark Office*